US006752290B2

(12) United States Patent
Tramontina

(10) Patent No.: US 6,752,290 B2
(45) Date of Patent: Jun. 22, 2004

(54) STACKED PAPER PRODUCT DISPENSING CARTRIDGE

(75) Inventor: Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/199,371

(22) Filed: Jul. 19, 2002

(65) Prior Publication Data

US 2002/0179624 A1 Dec. 5, 2002

Related U.S. Application Data

(63) Continuation of application No. 09/703,529, filed on Nov. 1, 2000, now Pat. No. 6,422,416, which is a continuation-in-part of application No. 09/156,230, filed on Sep. 18, 1998, now Pat. No. 6,241,118, which is a continuation-in-part of application No. 08/991,669, filed on Dec. 16, 1997, now Pat. No. 6,419,113.

(51) Int. Cl.[7] ..... A47K 10/24; B65H 1/00
(52) U.S. Cl. ..... 221/46; 221/47; 221/63
(58) Field of Search ..... 221/34, 45, 46, 221/47, 63; 206/732, 748, 772

(56) References Cited

U.S. PATENT DOCUMENTS 371,473 A 10/1887 Onderdonk
371,743 A 10/1887 Onderdonk (List continued on next page.)

FOREIGN PATENT DOCUMENTS

DE 1289274 2/1969
EP 331027 A1 2/1989

(List continued on next page.)

OTHER PUBLICATIONS

English translation of Taiwanese Patent Publication No. 195789.
English translation of EPO 0910273 B1.
General Catalogue '93 (in both Spanish and English), Lineacqualba.
Marplas Catalog (in both Spanish and English), Lineacqualba.
CEMASA Commerical Catalog (Italian), Jun. 30, 1999.
English Translation of CEMASA Commerical Catalog, Jun. 30, 1999.
U.S. patent application No. 08/534,179, filed Sep. 26, 1995.
U.S. patent application No. 08/528,402, filed Sep. 14, 1995.
U.S. patent application No. 08/755,435, filed Nov. 22, 1996.
Abstract for France Patent No. 2362610.

(List continued on next page.)

*Primary Examiner*—Gene O. Crawford
(74) *Attorney, Agent, or Firm*—Douglas Tulley, Esq.; Dority & Manning, P.A.

(57) ABSTRACT

A stacked paper product dispensing cartridge is disclosed including a plurality of walls including side walls and at least one end wall, the end wall having four side edges and each of the side walls having a bottom edge, each of the side edges meeting the bottom edge of a respective one of the side walls to form a bottom corner, the side walls and the end wall defining an interior area therein. A dispensing opening is defined within at least the end wall, and a plurality of side openings are defined within the side walls and spaced from the dispensing opening. Stacked paper products are disposed in the interior area oriented so as to extend substantially perpendicular to at least one of the side walls, the stacked paper products being dispensable out of the interior area through the dispensing opening and wherein at least one of the side openings is configured to allow contact of the stacked paper products from outside of the interior area. Additional openings may be provided extending across at least one of the bottom corners.

43 Claims, 8 Drawing Sheets

U.S. PATENT DOCUMENTS

| | | | | | |
|---|---|---|---|---|---|
| 813,594 | A | | 2/1906 | Sexton | |
| 1,170,380 | A | | 2/1916 | Winter | |
| 1,236,055 | A | | 8/1917 | Cohn | |
| 1,579,429 | A | | 4/1926 | Arms et al. | |
| 1,605,231 | A | | 11/1926 | Hoberg | |
| 1,665,057 | A | | 4/1928 | Genest | |
| 1,709,214 | A | | 4/1929 | Griffith | |
| D92,455 | S | | 6/1934 | Coles | |
| 1,974,926 | A | | 9/1934 | Marsh | |
| 1,989,381 | A | | 1/1935 | Samson | |
| 2,033,582 | A | | 3/1936 | Materno | |
| 2,143,614 | A | | 1/1939 | Winter et al. | |
| 2,195,437 | A | | 4/1940 | West | |
| 2,323,395 | A | | 7/1943 | Harwood | |
| 2,730,267 | A | | 1/1956 | Marcalus | |
| 2,816,376 | A | | 12/1957 | Hirvonen | |
| 2,858,016 | A | | 10/1958 | Marano | |
| 2,858,045 | A | | 10/1958 | Loeb | |
| 3,028,047 | A | | 4/1962 | Tuft | |
| 3,106,314 | A | | 10/1963 | Spears | |
| 3,156,378 | A | | 11/1964 | Bua | |
| 3,161,336 | A | | 12/1964 | Loescher | |
| 3,164,298 | A | | 1/1965 | Repko | |
| 3,203,586 | A | | 8/1965 | Downham | |
| 3,258,114 | A | | 6/1966 | King | |
| 3,272,385 | A | | 9/1966 | Watkins | |
| 3,332,594 | A | * | 7/1967 | De Capua | 221/185 |
| 3,343,716 | A | | 9/1967 | Peebles | |
| 3,349,959 | A | | 10/1967 | Watkins | |
| 3,724,716 | A | | 4/1973 | Baraconi et al. | |
| 3,747,802 | A | | 7/1973 | Uroshevich | |
| 3,754,681 | A | | 8/1973 | Slye et al. | |
| 3,843,085 | A | | 10/1974 | Castro | |
| 4,004,691 | A | | 1/1977 | Wihksne | |
| 4,411,374 | A | | 10/1983 | Hotchkiss | |
| D275,345 | S | | 9/1984 | Hall | |
| 4,469,243 | A | | 9/1984 | Ito et al. | |
| 4,491,242 | A | * | 1/1985 | Trinidad | 221/312 R |
| 4,566,607 | A | | 1/1986 | Smith | |
| 4,623,074 | A | | 11/1986 | Dearwester | |
| 4,678,099 | A | | 7/1987 | Matsui | |
| 4,679,703 | A | | 7/1987 | De Luca | |
| 4,706,844 | A | | 11/1987 | Omdoll et al. | |
| 4,768,679 | A | | 9/1988 | Matsui | |
| 4,805,800 | A | | 2/1989 | Nocek et al. | |
| 4,838,454 | A | | 6/1989 | Salzmann et al. | |
| D302,949 | S | | 8/1989 | Eisendrath | |
| 4,877,154 | A | | 10/1989 | Matsui | |
| 4,938,382 | A | | 7/1990 | Frazier et al. | |
| 5,002,200 | A | | 3/1991 | Hunt | |
| 5,020,670 | A | * | 6/1991 | Bedford | 206/499 |
| 5,065,895 | A | | 11/1991 | De Luca et al. | |
| 5,090,592 | A | | 2/1992 | Petterson et al. | |
| 5,100,020 | A | | 3/1992 | Petterson et al. | |
| 5,102,007 | A | | 4/1992 | Petterson et al. | |
| 5,143,252 | A | | 9/1992 | Shi | |
| 5,219,092 | A | | 6/1993 | Morand | |
| D347,344 | S | * | 5/1994 | Schumaker | D6/515 |
| 5,310,057 | A | | 5/1994 | Caldwell et al. | |
| 5,332,118 | A | | 7/1994 | Muckenfuhs | |
| 5,346,064 | A | | 9/1994 | Rizzuto | |
| 5,356,032 | A | | 10/1994 | Rhodes | |
| 5,460,322 | A | * | 10/1995 | Carlson et al. | 229/120 |
| 5,462,197 | A | | 10/1995 | Pound | |
| D366,583 | S | | 1/1996 | Scaife | |
| 5,509,571 | A | * | 4/1996 | Weber | 221/46 |
| 5,520,308 | A | * | 5/1996 | Berg, Jr. et al. | 221/50 |
| 5,590,813 | A | | 1/1997 | Abramczyk | |
| 5,622,281 | A | * | 4/1997 | Annand | 221/48 |
| 5,632,409 | A | | 5/1997 | Raghunanan | |
| 5,642,836 | A | * | 7/1997 | Merriweather, Jr. | 221/62 |
| 5,690,230 | A | * | 11/1997 | Griffith | 206/555 |
| 5,836,478 | A | * | 11/1998 | Weiss | 221/309 |
| 5,853,845 | A | | 12/1998 | McConnell et al. | |
| 5,931,339 | A | | 8/1999 | Dodge et al. | |
| D414,085 | S | | 9/1999 | Campbell | |
| 5,950,863 | A | * | 9/1999 | Schutz et al. | 221/46 |
| 6,241,118 | B1 | | 6/2001 | Tramontina | |
| 6,296,331 | B1 | | 10/2001 | Tramontina | |
| 6,354,462 | B1 | | 3/2002 | Conran et al. | |
| 6,415,949 | B1 | | 7/2002 | Tramontina | |
| 6,419,113 | B1 | | 7/2002 | Tramontina | |
| 6,422,416 | B1 | | 7/2002 | Tramontina | |

FOREIGN PATENT DOCUMENTS

| | | | |
|---|---|---|---|
| EP | 372781 | A1 | 6/1990 |
| EP | 419063 | A2 | 3/1991 |
| EP | 779053 | | 6/1997 |
| EP | 811348 | A2 | 12/1997 |
| EP | 0910273 | B1 | 1/1998 |
| FR | 336986 | | 11/1903 |
| FR | 1537127 | | 7/1968 |
| FR | 2362610 | | 3/1978 |
| GB | 423276 | | 1/1935 |
| GB | 1112680 | | 5/1968 |
| JP | 187873 | | 8/1991 |
| SE | 149028 | | 11/1952 |
| TW | 195789 | | 7/1981 |
| WO | WO 9709918 | | 3/1997 |
| WO | WO 97/11630 | | 4/1997 |
| WO | WO 972252 | | 6/1997 |
| WO | WO 97/22528 | | 6/1997 |
| WO | WO 9822009 | | 5/1998 |
| WO | WO 9840002 | | 9/1998 |
| WO | WO 9826702 | | 12/1998 |
| WO | WO 9930601 | | 6/1999 |
| WO | WO 9929137 | | 8/1999 |

OTHER PUBLICATIONS

U.S. patent application No. 08/991,669, filed Dec. 15, 1997, Atty. Docket No. 13400.

Abstract for Japan Patent No. 187873.

U.S. patent application No. 08/755,435, filed Nov. 22, 1996, Atty. Docket No. 12,995.

U.S. patent application No. 08/951,077, filed Nov. 15, 1997, Atty. Docket No. SC–3273.1.

U.S. patent application No. 08/246,690, filed Oct. 8, 1997, Atty. Docket No. SC–3300.1.

PCT Int'l. Search Report Int'l. Application No. PCT/US/98/26702, dated Mar. 31, 1999.

PCT Int'l. Search Report Int'l. Application No. PCT/US/99/29137, dated Aug. 12, 1999.

* cited by examiner

STACKED PAPER PRODUCT DISPENSING CARTRIDGE

RELATED APPLICATIONS

This application is a continuation of U.S. patent application Ser. No. 09/703,529, filed Nov. 1, 2000 U.S. Pat. No. 6,422,416, which is a continuation of U.S. patent application Ser. No. 09/156,230, filed Sep. 18, 1998 and now issued as U.S. Pat. No. 6,241,118, which is a continuation-in-part of U.S. patent application Ser. No. 08/991,669 filed on Dec. 16, 1997 U.S. Pat. No. 6,419,113. The disclosures of each of these applications are incorporated by reference herein.

BACKGROUND OF THE INVENTION

This invention relates generally to the field of dispensing devices and systems. More particularly, this invention relates to the field of devices and systems for dispensing paper products such as napkins, towels, toilet tissue, etc.

Various types of dispensers for paper products have been developed to provide ready availability of the paper product to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

Unfortunately, large dispensers are subject to a number of drawbacks. First, it is difficult to uniformly dispense individual paper products from a large dispenser without dispensing more paper products than necessary to a user. Thus, too many paper products are removed by a user, and some of the paper products are wasted. If too many paper products are removed from a dispenser, the benefits provided by a large dispenser are eliminated as the dispenser is emptied more rapidly.

Second, many dispensers are difficult to load, and that difficulty can increase with the size of the dispenser. If paper products are not properly loaded into the dispenser, the paper products may jam as they are removed thereby preventing further removal of paper products by users. Also, a person refilling a large dispenser is more likely, due to the larger number of paper products involved, to drop some of the paper products onto a floor. Any dropped paper products are then unsanitary and must be discarded, thereby creating more waste and again defeating the benefits of the larger dispenser.

A further drawback of many currently available dispensers regardless of size is that it is impossible to determine without opening the dispenser how many paper products remain within the dispenser. Thus, a person must either periodically check the dispenser to determine how many paper products remain or be vigilant to refill the dispenser as soon as it is empty. Both alternatives involve much personal attention and, especially during peak usage, can lead to empty dispensers if dispensers are not vigilantly monitored.

SUMMARY OF THE INVENTION

According to certain aspects of the invention, a stacked paper product dispensing cartridge is disclosed. The cartridge comprises a plurality of walls including side walls and at least one end wall, the end wall having four side edges and each of the side walls having a bottom edge. Each of the side edges meets the bottom edge of a respective one of the side walls to form a bottom corner, the side walls and the end wall defining an interior area therein. A dispensing opening is defined within at least the end wall, and a plurality of side openings are defined within the side walls and spaced from the dispensing opening. Stacked paper products are disposed in the interior area oriented so as to extend substantially perpendicular to at least one of the side walls. The stacked paper products are dispensable out of the interior area through the dispensing opening. At least one of the side openings is configured to allow contact of the stacked paper products from outside of the interior area.

The dispensing opening may be defined only through the end wall, or may be defined through the end wall and at least one of the side walls.

The plurality of walls may include first, second, third and fourth side walls, and the plurality of side openings may include a first side opening defined within the first side wall and a second side opening defined within the second side wall. The first and second side openings may be configured to allow contact of the stacked paper products from outside of the interior area. The first and second side walls may be opposing side walls. The plurality of side openings may further include at least one side opening located in the third wall and configured so as to provide a visual indication of the number of paper products within the interior area.

The at least one end wall may be formed not perpendicular to at least one of the side walls, and the side walls may be substantially longer than the at least one end wall. The at least one end wall may include two end walls disposed at opposite ends of the side walls.

The cartridge may also include at least one additional opening defined within the first end wall and one of the side walls so as to extend across one of the bottom corners. The at least one additional opening may include a plurality of the additional openings. Two of the bottom corners may be located along opposite side edges of the end wall, and at least one of the plurality of additional openings is respectively disposed along each of the two bottom corners.

A plurality of slot openings may be defined within the first end wall and at least one of the side walls such as the fourth wall, so as to extend across one of the bottom corners. The slot openings may be substantially diamond shaped.

According to other aspects of the invention, a cartridge for stacked paper products is disclosed including a cartridge housing a plurality of side walls and end walls, and wherein the end walls contact the side walls to define an interior area. A dispensing opening is defined within a first end wall, and a first side opening is defined within a first side wall. A second side opening is defined within a second side wall, and the second side wall is opposite the first side wall. Stacked paper products are disposed in the interior area oriented so as to extend substantially perpendicular to the side walls.

The dispensing opening may be defined entirely within the first end wall, or may be defined within the first end wall and a third side wall. A third side opening may be located in the third side wall and configured so as to provide a visual indication of the number of paper products within the interior area.

According to another aspect of the invention, a stacked paper product dispensing cartridge is disclosed including a cartridge including a plurality of side walls and first and second end walls. The end walls contact the side walls to define an interior area. A dispensing opening is at least partially defined within the first end wall, and at least one slot opening defined within the first end wall and one side wall. Stacked paper products are disposed in the interior area oriented so as to extend substantially perpendicular to at least one of the side walls. The at least one slot opening may be a plurality of slot openings, and at least one of the slot openings may be defined within the first end wall and first side wall, and at least one of the slot openings may be defined within the first end wall and a second end wall. The first and second end walls may oppose one another. The dispensing opening may be sized to provide metered delivery of paper products, and may be centrally located within the first end wall. A plurality of the slot openings may be positioned on opposite sides of the dispensing opening. A first side opening may be at least partially defined within a third side wall and a second side opening may be at least partially defined within a fourth side wall, the side openings configured to allow contact of the stacked paper products from outside of the interior area. A side opening may be located in the second side wall and configured so as to provide a visual indication of the number of paper products within the interior area.

The at least one slot opening may be a plurality of slot openings, and the plurality of slot openings may be defined within the first end wall and a first side wall. The dispensing opening may be defined within the first end wall and a second side wall.

The first side wall and second side wall may oppose one another, and a side opening may be located in the second side wall and configured so as to provide a visual indication of the number of paper products within the interior area. A first side opening may be defined within at least a third side wall, and a second side opening may be at least partially defined within a fourth side wall, the side openings configured to allow contact of the stacked paper products from outside of the interior area.

According to another aspect of the invention, a stacked paper product dispensing cartridge is disclosed including a plurality of walls including side walls and first and second end walls. The end walls contact the side walls at opposite ends thereof and define an interior area therein. A first removable section is provided for forming a dispensing opening, the first removable section including at least a portion of the first end wall and one side wall. A plurality of side openings are defined within the side walls and are spaced from the removable section. Stacked paper products are disposed in the interior area oriented so as to extend substantially perpendicular to at least one of the side walls. The stacked paper products are dispensable out of the interior area through the dispensing opening. The side openings are configured to allow contact of the stacked paper product from outside of the interior area.

The dispensing opening may be created by removing all of the first end wall and a portion of at least one of the side walls. The side walls may include first, second, third and fourth side walls, and the plurality of side openings may include a first side opening defined within the first side wall and a second side opening defined within the second side wall. The first and second side openings maybe configured to allow contact of the paper products from outside of the interior area. The first and second side walls may be opposing side walls, and an additional opening may be located in the third wall and configured so as to provide a visual indication of the number of paper products within the interior area. The removable section may include the entire first end wall and a portion of the first, second, third and fourth side walls, the side walls may be substantially longer than the end walls.

Additional aspects, objects, and advantages of the invention will be set forth in part in the following description, or may be learned through the practice of the invention.

BRIEF DESCRIPTION OF THE DRAWINGS

The present invention will be more fully understood from the following detailed description, taken in conjunction with the accompanying drawings, wherein like reference numerals refer to like parts, and in which.

DETAILED DESCRIPTION OF THE PREFERRED EMBODIMENTS

Figure 1:
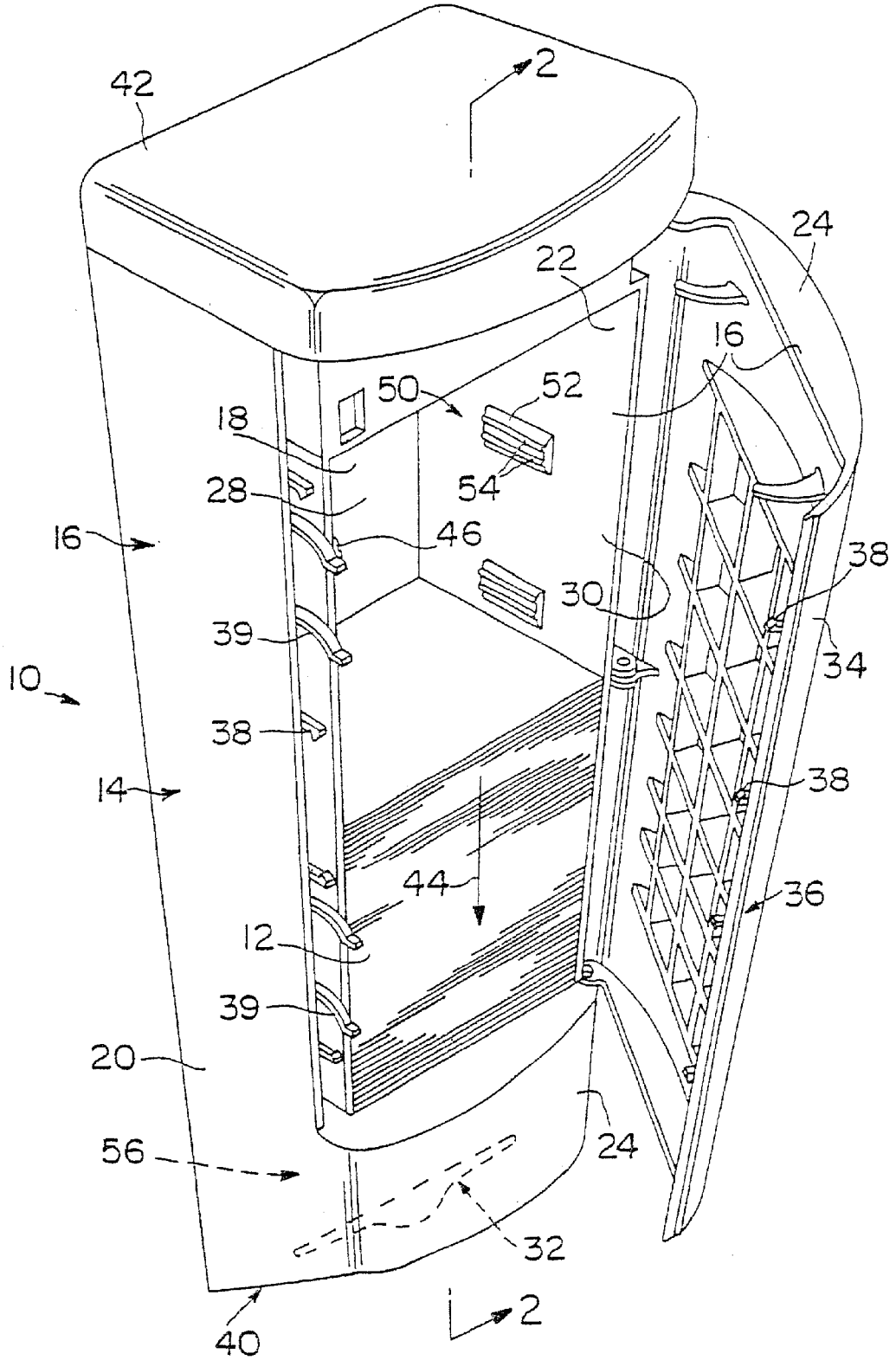
FIG. 1 is a perspective view of an exemplary container for dispensing paper products according invention.

Reference will now be made in detail to the presently preferred embodiments of the invention, one or more examples of which are illustrated in the drawings. Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

As broadly embodied in FIGS. 1–5, a first embodiment of container 10 is disclosed for dispensing paper products 12. Container 10 includes a housing 14 in which paper products 12 are placed and from which paper products 12 are dispensed. Paper products 12 may be paper napkins, paper towels, toilet tissue, or any other similar material.

Figure 2:
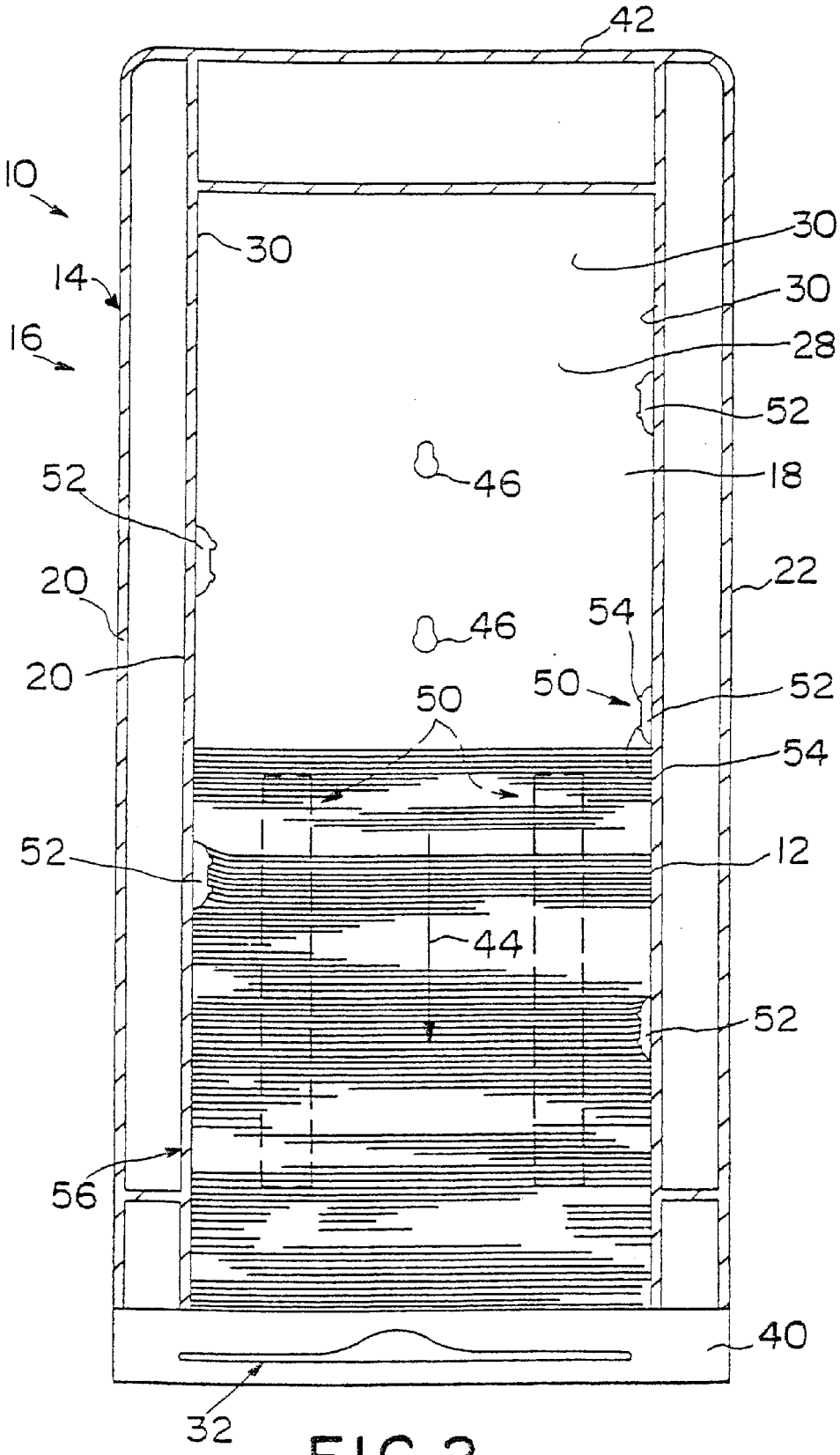
FIG. 2 is a cross-sectional view of the container of FIG. 1 taken along line 2—2 in FIG. 1.

Housing 14 includes a number of exterior walls 16 for housing paper products 12. The housing 14 includes a first end wall 40 and a second end wall 42 opposite the first end wall 40. The first end wall 40 includes a dispensing throat 32 through which paper products 12 are individually removed by a user, as will be described below. A first wall 18, a second wall 20 and a third wall 22 intersect the first end wall 40, the second wall 20 and third wall 22 being on opposite sides of the first wall 18. A fourth wall 24 extends between second wall 20 and third wall 22. The exterior wall 16 (i.e., first wall 18, second wall 20, third wall 22 and fourth wall 24) together define an interior surface 30 of housing 14, within which an interior area 28 is located. As shown in FIGS. 1 and 2, exterior walls 16 and end walls 40 and 42 may each, if desired, be made of two planar portions. Such construction strengthens housing 14 and is useful in locations where the housing might be vandalized. The outer portions of walls 16 help withstand any blow or impact to housing 14 to prevent its destruction or removal of the housing from its mounting or paper products from the housing.

As shown in FIG. 1, fourth wall 24 includes a door 34 which may be hingedly attached to third wall 22 (or to the second wall 20). Door 34 is openable for insertion of paper products 12 into interior area 28 of housing 14 when the supply of paper products 12 runs low. Door 34 includes a latching mechanism 36 including a number of interfering notched tabs 38 on door 34 and second wall 20 that hold door 34 closed. Tabs 38 on either door 34 or second wall 20 are movable when desired to reopen door 34 by turning a key lock (now shown). The lock may be either located on door 34, in which case the tabs 38 on door 34 are movable, or on the main part of housing 14, in which case the tabs 38 on second wall 20 are movable. Leaf springs 39 may be provided to assist in reopening door 34 upon unlocking. Any other type of latching mechanism for reopenably securing door 34 may be used within the scope of the invention.

It is contemplated that the fourth wall 24 may be fixed and the paper products 12 may be inserted into the interior area 28 of the housing 14 through the second end wall 42. In such case, the second end wall 42 may be fitted with latches, springs and the like. It is also contemplated that the second end wall may be removed entirely and that portion of the housing be left open.

In accordance with the invention, a means is provided for urging paper products 12 within interior area 28 toward dispensing throat 32 in a dispensing direction 44. Various alternatives are possible within the scope of the invention to urge paper products 12 toward dispensing throat 32 in dispensing direction 44.

For example, as shown in FIGS. 1 and 2, an attachment portion 46 of housing 14 may be provided for attaching housing 14 to a substantially nonhorizontal surface such as vertical wall 48. As shown in FIG. 2, attachment portion 46 may define holes through first wall 18 of housing 14 for receiving attachment members (not shown) such as screws, bolts, nails, etc. for attaching housing 14 to wall 48. Alternatively, a mounting bracket could be formed on an exterior surface of first wall 18 for contacting and being supported by another bracket, screws, bolts, nails, etc. extending from wall 48. Further, housing 14 could be secured to wall 48 via a glue, epoxy, etc., or any other type of adhesive. Also, it would be possible to locate attachment portion 46 on any part of housing 14, such as second wall 20, third wall 22, first end 40, or second end 42, and to use combinations of mounting devices on several of the above-identified parts of housing 14. Further, housing 14 could simply be portioned such that first end 40 is lower than second end 42, and so that first end 40 and possibly first wall 18 are supported in some way without fixing housing 14 to any particular structure.

Thus, the means for urging paper products 14 toward dispensing throat 32 in dispensing direction 44 may comprise any structure or orientation, or both, of housing 14 and/or wall 48 that allows paper products 12 to be dispensed from dispensing throat 32 and to be urged in dispensing direction 44 by gravity. A second type of a mechanism for urging paper products 12 toward dispensing throat 32 in dispensing direction 44 will be discussed below in relation to a second embodiment (110) of container 10.

In accordance with the invention, at least one protrusion, referred to generally as 50, extends from interior surface 30 on at least one of exterior walls 16 into interior area 28 of housing 14. Preferably, as shown in FIG. 2, second wall 20 and third wall 22 include protrusions 50 extending into interior area 28. Protrusions 50 preferably comprise curved bumpers 52, which may include a plurality of ridges 54 extending across the curved bumpers perpendicular to dispensing direction 44.

As shown bet in FIG. 2, bumpers 52 extend into interior area 28 to contact paper products 12 and thereby oppose the means for urging paper products 12 in dispensing direction 44. By extending into interior area 28 to contact paper products 12, bumpers 52 impede the movement of paper products 12 toward dispensing throat 32, but do not prohibit such movement. Ridges 54 allow numerous paper products 12 to be contacted by an individual bumper and allow for a smoother movement of paper products through housing 14. In embodiments where the means for urging paper products 12 in dispensing direction 44 includes mounting housing 14 so that gravity causes such movement, protrusions 50 also support paper products 12 against the force of gravity. Protrusions 50 therefore reduce the gravitational force of the bottom of the paper products 12 on dispensing throat 32, thereby making it easier for a user to remove the individual paper products from dispensing throat 32.

Figure 3:
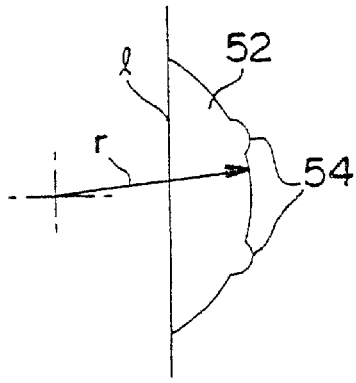
FIG. 3 is a view of a cross-section of an exemplary curved bumper protrusion of the container shown in FIG. 2.

FIG. 3 shows a preferred profile of one of the bumpers 52. As shown, the exterior curve of bumper is defined by a radius r of about 1.125 to 1.750 in. The bumper has a chordal length 1 of from about 1.625 to 1.875 in. Two ridges 54 each have a radius of from about 0.125 to 0.250 in., and their centers are each spaced about 0.250 in. from the center of bumper 52. While the disclosed bumper shape is the currently preferred shape, other shapes could be used if desired.

In accordance with the invention, protrusions 50 on second wall 20 are desirably staggered from protrusions 50 on third wall 22 relative to dispensing direction 44. Such staggering provides a smooth movement of paper products 12 along dispensing direction 44 and out dispensing throat 32. Paper products 12, being supported alternatively on one side or the other by the staggered protrusions 50, "walk" down housing 14 in dispensing direction 44 and out dispensing throat 32. Staggering protrusions 50 in dispensing direction 44 is important in embodiments where paper products 12 are moved in dispensing direction 44 due to the mounting or orientation of housing 14 by gravity. For example, if protrusions 50 were spaced opposite from each other on second wall 20 and third wall 22, paper products 12 might be entirely prevented from moving in dispensing direction and thus sit on top of a pair of protrusions 50. Also, paper products 12 might unevenly move in spurts past a pair of non-staggered protrusions 50 which could lead to misaligning of paper products and ultimately jamming of paper products within housing 14. Thus, staggering of protrusions 50 allows an orderly walking of paper products 12 along housing 14 in dispensing direction 44 where first one side of the paper products, and then the other, moves more steadily toward dispensing throat 32.

Figure 4A:
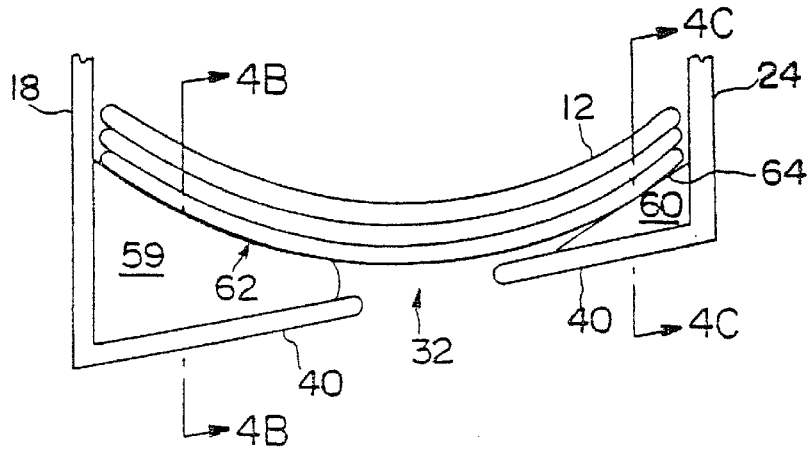
FIG. 4A is a partial sectional view of a lower portion of the container shown in FIG. 1 taken along a line perpendicular to line 2—2 in FIG. 1 showing an exemplary arrangement of rib members.
Figure 4B:
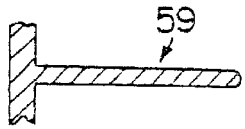
FIG. 4B is a cross-sectional view of an exemplary tall rib member taken along line 3—3 of FIG. 4A.

Preferably, container 10 includes a second group of protrusions 50 extending from first wall 18 and fourth wall 24 into interior are 28 to contact paper products 12. The second group of protrusions 50 is preferably disposed in a staging area 56 near dispensing throat 32 for spacing, slowing, aligning and supporting paper products 12 as they are moved in dispensing direction 44 through dispensing throat 32. Preferably, the second group of protrusions 50 includes several rib members 58 extending parallel to dispensing direction 44 on both sides of the dispensing throat 32 as shown in FIG. 4A. Rib members 58 may have different dimensions to properly support and guide the paper products 12 into the dispensing throat 32 as illustrated in FIG. 4B. In particular, a tall rib member 59 which is adjacent first wall 18 and first end wall 40 extend into the interior area 28 by a greater amount than short rib member 60. Tall rib member 59 is illustrated to show an exemplary sloping configuration and an optional radius of curvature. As can be seen in FIG. 4A, a top surface 62 of the tall rib member 59 closest to the dispensing throat 32 may be offset from the first end wall 40. The short rib member 60 is adjacent the fourth wall 24 and the first end wall 40. The short rib member 60 is illustrated to show an exemplary sloping configuration. As illustrated in FIG. 4A, a top surface 64 of the short rib member 60 may be configured so there is no offset from the first end wall 40.

Generally speaking, the tall rib member 59 may have a height ranging from about 1 to about 2 inches at the location where it intersects with the first wall 18 and an offset or height ranging from about 0.1 to about 0.5 inch adjacent the dispensing throat. As an example, the tall rib member 59 may have a height of about 1.5 inch at the location where it intersects with the first wall 18 and an offset or height of about 0.25 inch adjacent the dispensing throat.

The short rib member 60 may have a height ranging from about 0.5 to about 1.5 inch at the location where it intersects with the fourth wall 24 and an offset or height ranging from 0 to about 0.24 inch adjacent the dispensing throat. As an example, the short rib member 60 may have a height of about 0.75 inch at the location where it intersects with the fourth wall 28 and no offset or height adjacent the dispensing throat.

However, it should be understood that the dimensions of these rib members may be varied to accommodate a variety of factors including, but not limited to, the size of the paper product, basis weight of the paper product, composition/texture of the paper product, fold pattern of the paper product, height of the stack of paper products, force supplied by the means to urge the paper products to the dispensing throat, amount and dimensions of protrusions located on the second and third walls of the container as well as amount of other rib members positioned proximate the dispensing throat.

Figure 4C:
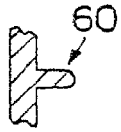
FIG. 4C is a cross-sectional view of an exemplary short rib member taken along line 4—4 of FIG. 4A.

FIG. 4B is a sectional view taken along line 3—3 in FIG. 41 showing a portion of an exemplary tall rib member 59. FIG. 4C is a sectional view taken along line 4—4 in FIG. 4A showing a portion of an exemplary short rib member 60. The rib members may have various widths or thicknesses and the width of a rib member may vary along any dimension or dimensions. Desirably, the portion of the rib member contacting the paper product will be relatively thin and smooth to minimize friction.

Figure 4D:
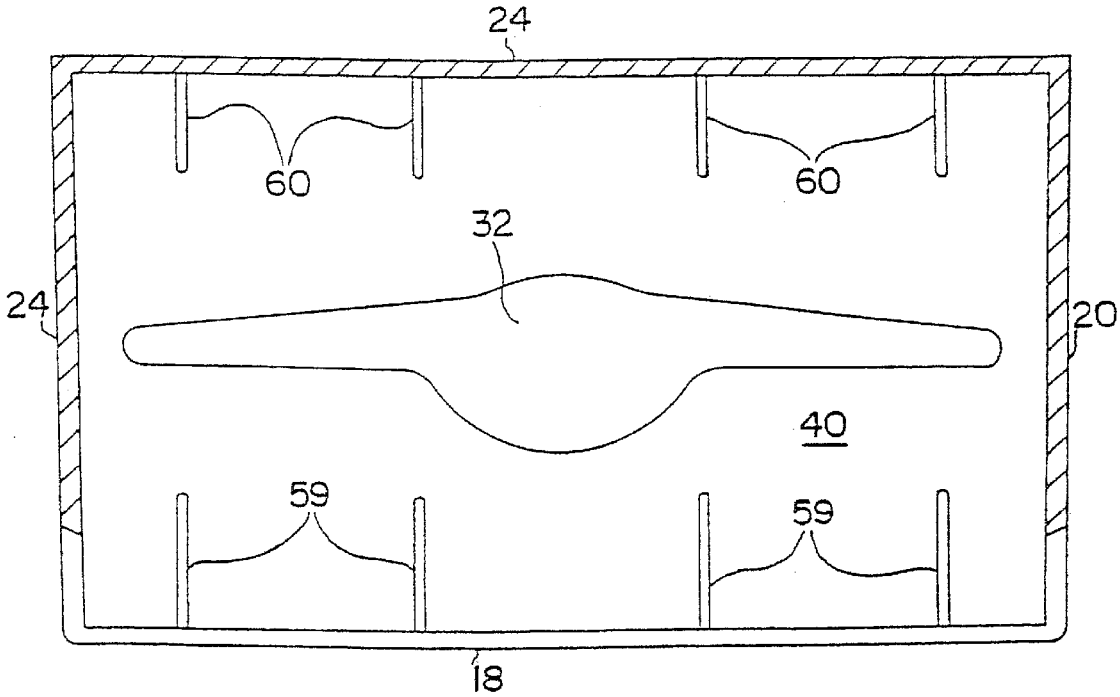
FIG. 4D is a top view showing an exemplary arrangement of rib members proximate a dispensing throat.

FIG. 4D is a view from the interior of a container for dispensing papers looking out through the dispensing throat 32 and illustrating a top view of exemplary rib members 58.

Housing 14 may be made of injection-molded plastic such as plyethylene or nylon. However, other suitable materials, such as other plastics or metals, may be provided for any or all of the parts of housing 14. Curved bumpers 52 and rib members 58 are preferably formed integral with housing 14. However, curved bumpers 52 and rib members 58 may be formed separately from housing 14 and attached later. Also, curved bumpers 52 and rib member 58 may be made of different material from housing 14 if desired. For example, curved bumpers 52 and/or rib members may be made of a more resilient material than the materials described above, such as an elastomer or rubber.

While curved bumpers 52 have been described as disposed on second or third walls 20 and 22, which are side walls in FIGS. 1 and 2 where housing 14 is mounted to wall 48, curved bumpers 52 could be disposed on any pair of opposite walls of housing 14. Also, although rib member or members 58 have been described as disposed on first and fourth wall 18 and 24, which are front and back walls in FIGS. 1 and 2, rib member or members 58 could be disposed on any wall or pair of opposite walls of housing. Preferably, curved bumpers 52 are disposed on one such pair of walls and rib member or members 58 are disposed on one or both of a different pair of side walls located 90 from those on which curved bumpers 52 are located.

Dispensing throat 32 may have many shapes within the scope of the present invention, as long as the throat provides easy access for a user and metered delivery of individual paper products.

Preferably, paper products 12 are interfolded or tab interfolded to provide metered feeding of individual napkins one at a time. However, the present invention does not require the use of interfolded paper products.

Figure 5:
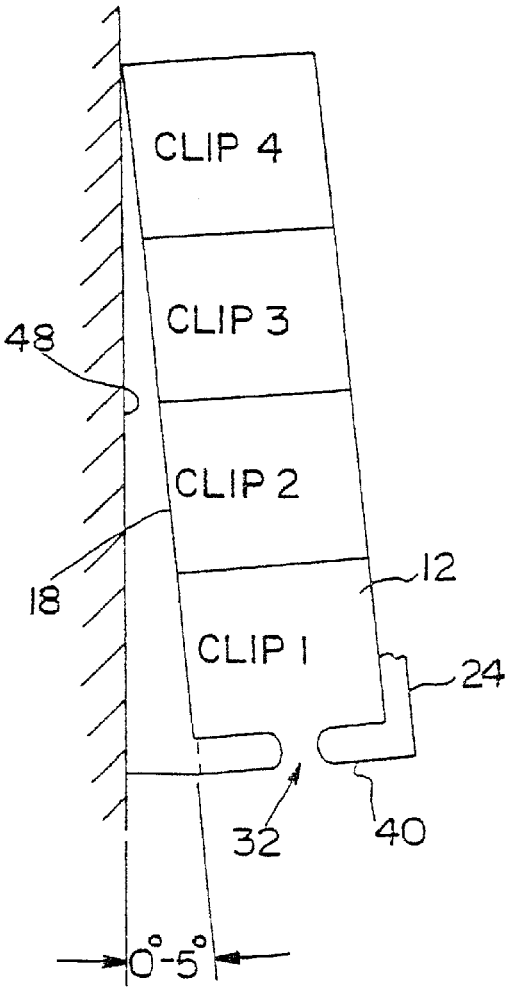
FIG. 5 is a diagrammatical view of a preferred mounting arrangement of the container shown in FIG. 2, mounted on a substantially vertical wall.

Housing 14 may hold multiple clips of paper products 14, as shown in FIG. 5, and may extend from 30 to as much as 48 in. from end to end. Preferably, first wall 18 is angled between 0–5 from the vertical to prevent paper products from falling out of housing 14 during refilling.

Figure 6:
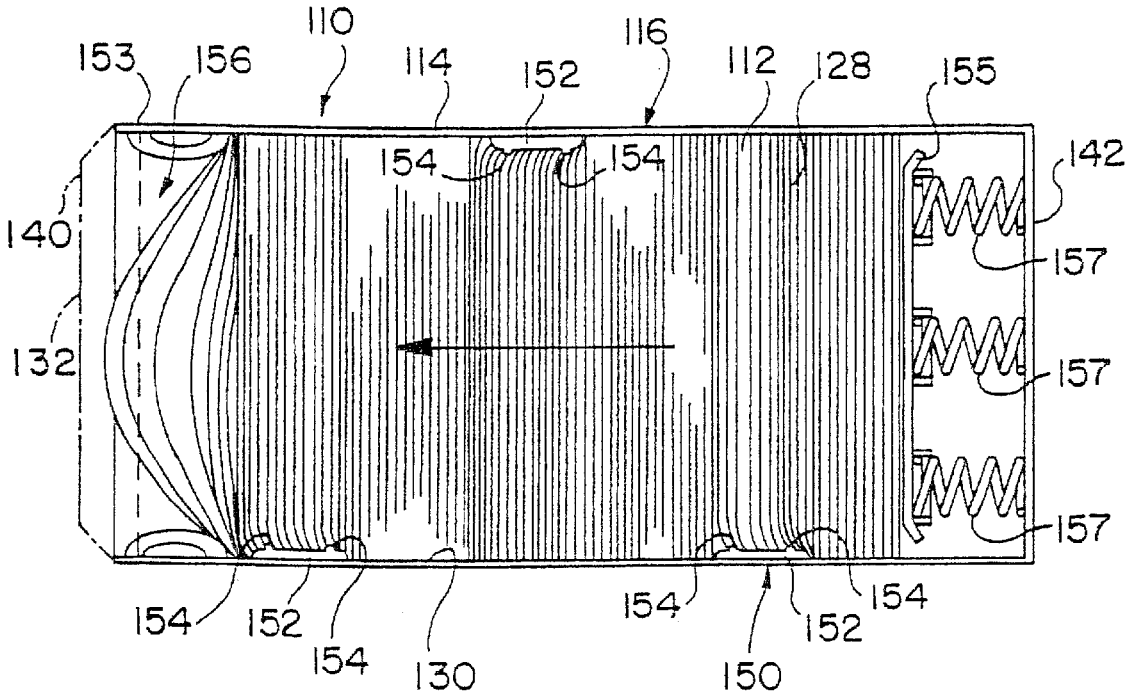
FIG. 6 is a sectional view of an exemplary container according to another embodiment of the invention.

A second embodiment of the present invention is shown in FIG. 6, which discloses a container 110 similar to container 10 in most ways. Container 110 includes a housing 114 holding paper products 112 and including exterior walls 116. The paper products 112 are dispensed in a dispensing direction 144 through a dispensing throat 132. At least one protrusion 150 extends from interior surface 130 into interior area 128 to contact paper products 112.

Protrusions 150 include curved bumpers 152 including ridges 154 similar to those discussed above in connection with the first embodiment of the invention. Curved bumpers 152 are staggered in dispensing direction 144 as discussed above. A staging area 156 is provided adjacent dispensing throat 132 at first end 140 of housing 114. Staging area 156 includes additional curved bumpers 153 not staggered in dispensing direction 144. Bumpers 153 allow paper products 112 to bow at the middle toward dispensing throat 132 to make it easier for a user to remove a single paper product from dispensing throat 132.

In container 110, the means for urging paper products 112 from interior area 128 toward dispensing throat 132 in dispensing direction 144 is different from that of container 10. As shown in FIG. 6, a spring-loaded plate 155 is disposed within second end 142 of housing 114 along with at least one spring 157. When spring 157 is compressed by spring-loaded plate 155, spring 157 urges spring-loaded plate 155 in dispensing direction 144. Thus, when paper products 112 are placed in container 110 and spring-loaded plate is pushed to the right (as shown in FIG. 6) thereby compressing spring 157, spring-loaded plate 155 and spring 157 urge paper products 112 in dispensing direction 144 toward dispensing throat 132. Use of a spring-loaded plate and spring mechanism allows container 110 to be used in situations where dispensing direction 144 is substantially horizontal. Thus, container 110, which provides spring-loaded urging, can be used in locations where container 10, which provides gravity-assisted urging, could not. It should be understood that the staging bumpers 153 of container 110 could be replaced with rib members similar to those used with container 10 shown in FIG. 1 and as depicted, for example in FIG. 4A through FIG. 4D.

Figure 8B:
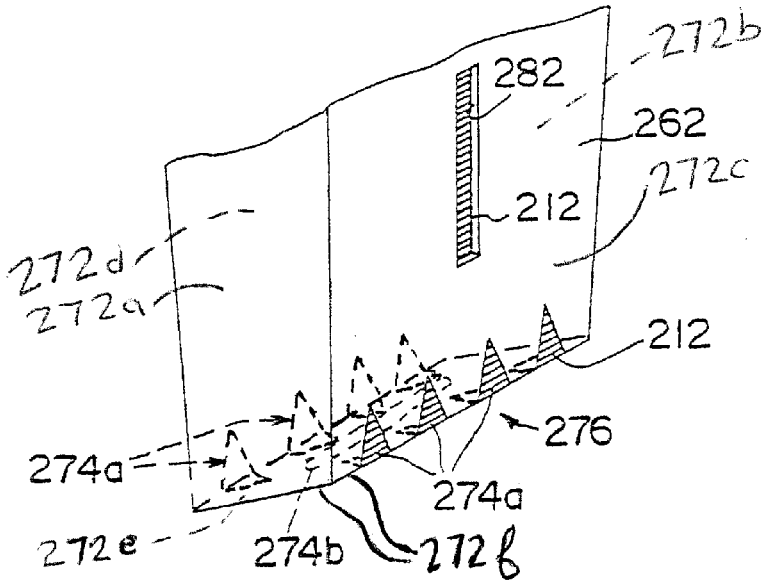
FIG. 8B is a partial perspective view showing another embodiment of the cartridge of FIG. 8A.
Figure 7:
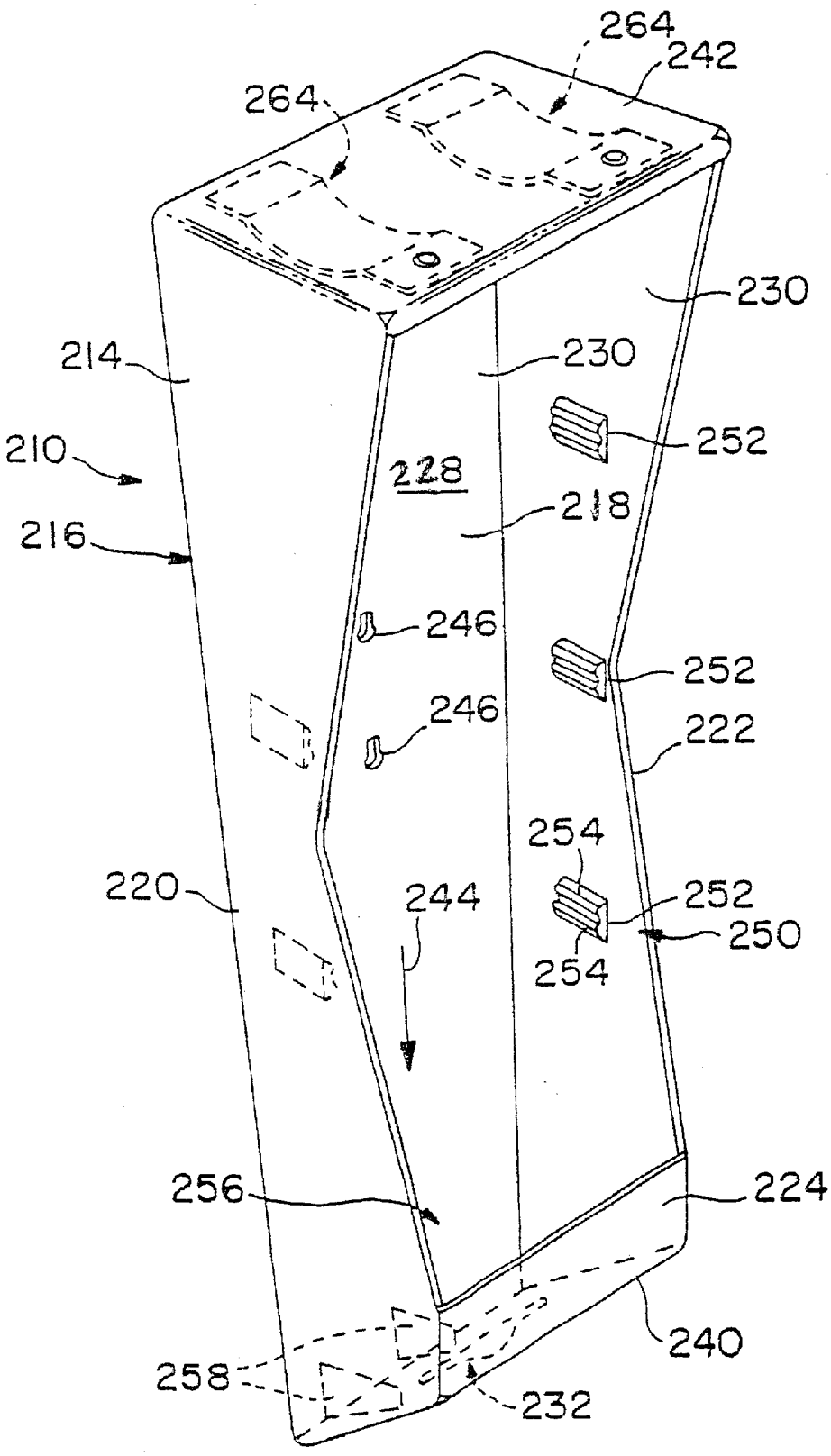
FIG. 7 is perspective view of an exemplary housing of a container according to yet embodiment of the present invention.

In accordance with the third embodiment of the present invention, a container 210 is provided for holding paper products 212 to be dispensed to a user. As shown in FIGS. 7–9, container 210 includes a housing 214 defined by exterior walls 216, including first wall 218, second wall 220, third wall 222, and fourth wall 224. Exterior walls 216 define an interior surface 230, within which is disposed an interior area 228. A dispensing throat 232 is provided through first end wall 240 which is positioned opposite a second end wall 242. Paper products 212 are dispensed in a dispensing direction 244 through dispensing throat 232. Housing 214 includes plurality of protrusions 250, including curved bumpers 252 having ridges 254 and rib members 258 disposed in a staging area 256.

However, housing 214 need not include a door, as found in some other embodiments of the invention, although a door may be provided for security reasons. In this embodiment, the fourth wall 224 is quite small and located near the dispensing throat 232 in the first end wall 240 leaving a face of the container 210 substantially open. Further, housing 214 can also be constructed with double walls, as in housing 14, for security reasons. Also, paper products 212 are not directly loaded into interior area 228, as in the first and second embodiments.

Figure 8A:
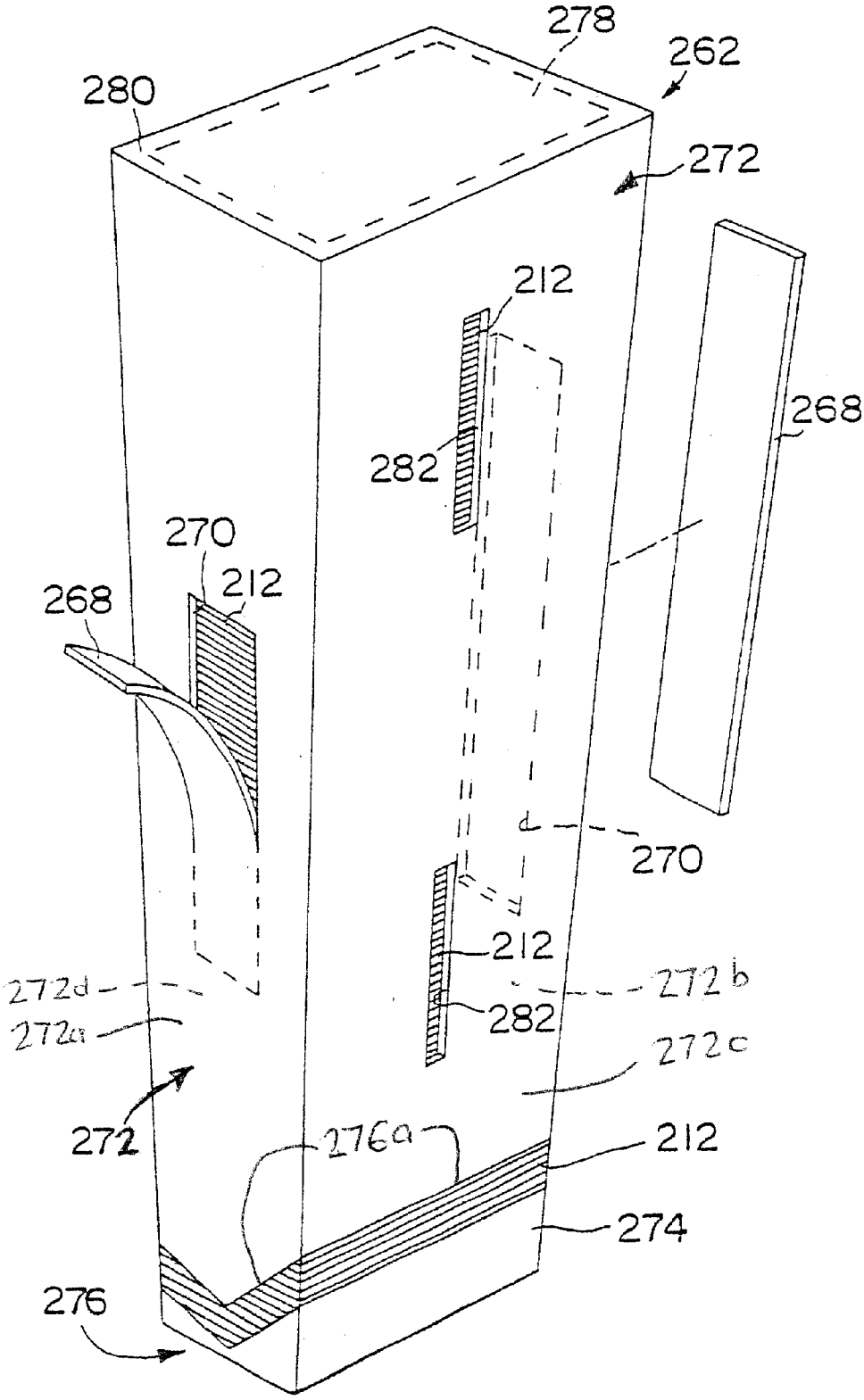
FIG. 8A is a perspective view of an exemplary cartridge according to an embodiment of the present invention shown in FIG. 7.
Figure 9:
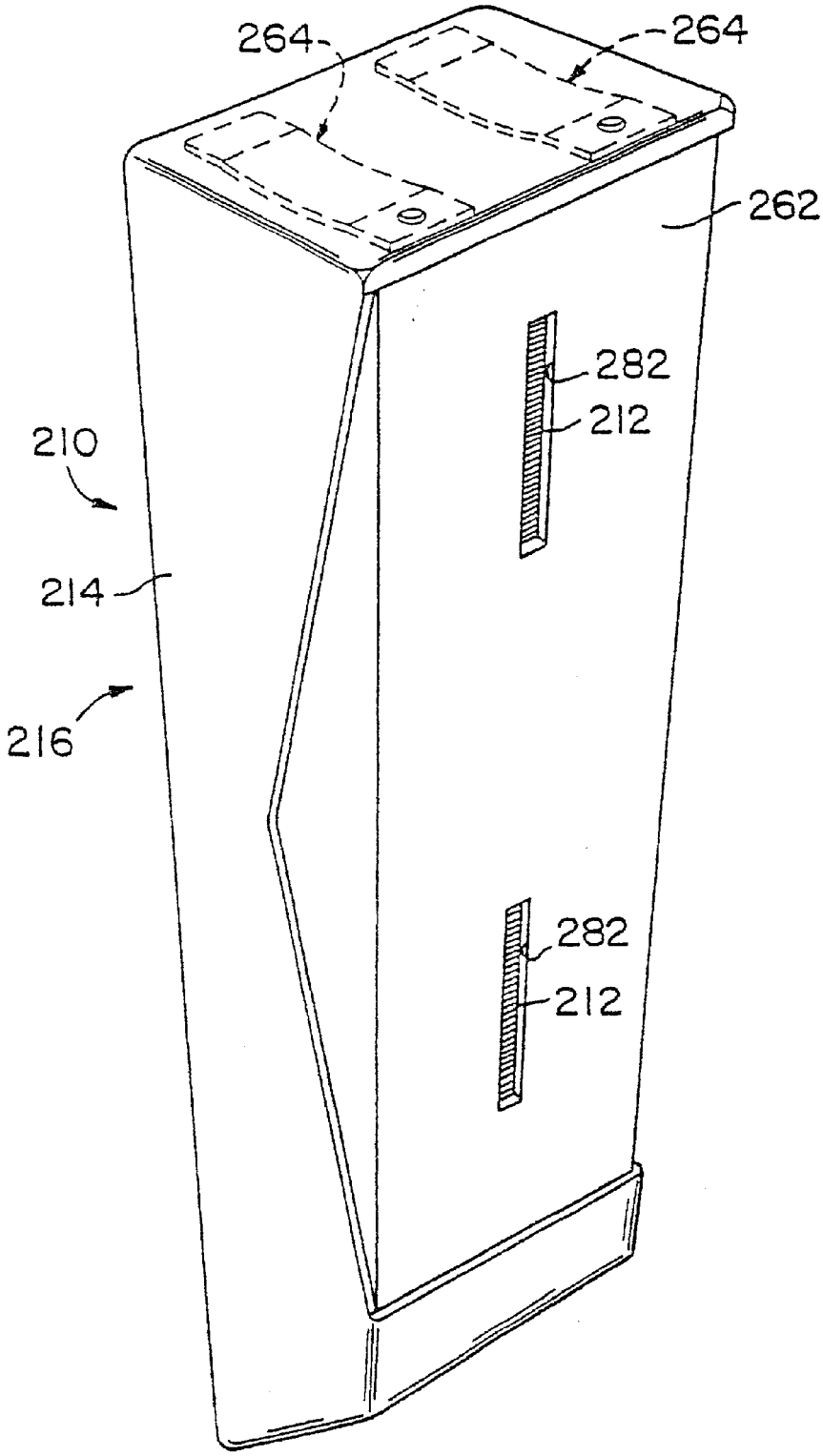
FIG. 9 is a perspective view of an embodiment of the invention showing an exemplary cartridge placed in an exemplary housing depicted in FIG. 7.

As shown in FIG. 8A, a cartridge 262 is provided for insertion into interior area 228 of housing 214 for containing paper products 212 to be dispensed. As shown in FIG. 7, cartridge 262 has first through fourth outside walls 272*a–d*, and end wall 272*e* configured and sized to fit snugly within interior area 228 of housing 214. Outside walls 272*a–d* have bottom edges that meet side edges of end wall 272*e* at a respective bottom corner 272*f*. If desired, leaf springs 264 may be provided attached to the inside of second end 242 of housing 214 to hold cartridge 262 in place. Any other suitable mechanism such as a tab or other interlock may be used to hold cartridge 262 in housing 214 within the scope of the invention.

Preferably, cartridge 262 includes a plurality of removable portions 268, the removal of which creates side openings 270 through cartridge 262. As shown in FIG. 8A, cartridge 262 includes a plurality of removable portions 268 that create side openings 270 upon removal.

Removable portions 268 are disposed in outside walls 272*a* and 272*b* of cartridge 262 so that, once removable portions 268 are removed, side openings 270 may encompass and receive protrusions 250 extending from interior surface 230 of housing 214.

Cartridge 262 may also include another removable portion 278 disposed at end 280 of cartridge 262. Removable portion 278 may be removed to receive a spring-loaded plate if cartridge 262 is to be used in a container such as that shown in FIG. 6 with a spring-loaded plate.

As shown in FIG. 8A, a removable portion 274 may be provided at end 276 of cartridge 262 to create a dispensing opening along edge 276*a* so that paper products 212 can be supported and aligned by rib members 258 for dispensing through dispensing throat 232. Alternatively, end 276 of cartridge 262 may be formed as shown in FIG. 8B, so that removable portion 274 is not required and cartridge 262 fits into housing 214 without substantial modification of end 276. As shown in FIG. 8B, optional removable portions 274*a* may be placed on front outside wall 272*c* and/or a back wall 272*d* of cartridge 262. Removable portions 274*a* may be used if optional protrusions 258 (i.e., rib members of the type shown in FIGS. 4A–4D) are used on the first wall 218 and the fourth wall 224 of housing 214 (see, for example, FIG. 7). Such protrusions or rib members 258 may also be used on the first wall 18 and the fourth wall 24 of first embodiment housing 14, if desired. Thus, if desired, a plurality of smaller removable portions 274*a* (see FIG. 8B) may be provided corresponding to rib members 258, and a smaller removable portion 274*b* may be provided corresponding to dispensing throat 232. Of course, these removable portions 274*a* and 274*b* may simply not be formed or may be removed during manufacture of the cartridge. Removal of portion 274*a* creates an additional opening in the cartridge. Removal of portion 274*b* creates a dispensing opening. Each additional opening may comprise a diamond-shaped opening or slot, and may extend across a bottom corner 272*f*.

Removable portions 268, 278, 274*a* and 274*b* may either be removed (or simply not formed) during manufacture of cartridge 262 or removed during installation of cartridge 262 in housing 214. If removable portions 268, 278, 274*a* and 274*b* are to be removed as part of the manufacturing process, cartridge 262 should be shipped to the user wrapped, for example in a polyethylene bag, to preserve the sterility of the paper products in the cartridge. If removable portions 268, 278, 274*a* and 274*b* are to be removed as part of the installation process, the edges of the removable portions should be weakened, scored, etc. for easy removal. Removable portion 274 should not be removed as part of the manufacturing process to ensure that paper products 12 remain properly located in cartridge 262.

Thus, upon removal of removable portions 268 and 274*a* and placement of cartridge 262 in housing 214, curved bumpers 252 and rib members 258 contact the paper products 212 within the interior area of cartridge 262 via openings 270 and the additional openings and act just as the bumpers and rib members do in the first two embodiments of the invention.

Preferably, cartridge 262 includes at least one additional side opening which may comprise a slot 282 extending through one of the cartridge walls 272*c*. Slot 282 is visible from outside of housing 214 when cartridge 262 is mounted in interior area 228. A user can visually determine the amount of paper products 212 remaining within cartridge 262 by inspecting the amount of paper products visible through slot 282. As shown in FIG. 8A, two slots may be provided to provide a greater range of visual inspection. Any number or arrangement of slots is possible within the scope of the invention.

Cartridge 262 is preferably made of heavy paper or cardboard, but may be made of any other suitable material within the scope of the invention.

It will be apparent to those skilled in the art that various modifications and variations can be made in the present invention without departing from the scope and spirit of the invention. It is intended that the present invention include such modifications and variations as come within the scope of the appended claims and their equivalents.

I claim:

1. A stacked paper product dispensing cartridge comprising:

a plurality of walls including side walls and at least one end wall, the end wall having four side edges and each of the side walls having a bottom edge, each of the side edges meeting the bottom edge of a respective one of the side walls to form a bottom corner, the side walls and the end wall defining an interior area therein;

a dispensing opening being defined within at least the end wall;

a plurality of side openings defined within the side walls and spaced from the dispensing opening, and at least one additional opening defined within the first end wall and one of the side walls so as to extend across one of the bottom corners; and stacked paper products disposed in the interior area oriented so as to extend substantially perpendicular to at least one of the side walls, the stacked paper products being dispensable out of the interior area through the dispensing opening and wherein at least one of the side openings is configured to allow contact of the stacked paper products from outside of the interior area.

2. The cartridge of claim 1 wherein the dispensing opening is defined only through the end wall.

3. The cartridge of claim 1 wherein the dispensing opening is defined through the end wall and at least one of the side walls.

4. The cartridge of claim 1 wherein the end wall is not perpendicular to at least one of the side walls.

5. The cartridge of claim 1 wherein the side walls are substantially longer than the at least one end wall.

6. The cartridge of claim 1 wherein the at least one end wall includes two end walls disposed at opposite ends of the side walls.

7. The cartridge of claim 1 wherein the at least one additional opening comprises a plurality of slot openings defined within the first end wall and at least one of the side walls so as to extend across one of the bottom corners.

8. The cartridge of claim 1 wherein the at least one additional opening includes a plurality of the additional openings.

9. The cartridge of claim 8 wherein two of the bottom corners are located along opposite side edges of the end wall, and at least one of the plurality of additional openings is respectively disposed along each of the two bottom corners.

10. The cartridge of claim 1 wherein said plurality of walls includes first, second, third and fourth side walls and wherein the plurality of side openings include a first side opening defined within the first side wall and a second side opening defined within the second side wall, the first and second side openings configured to allow contact of the stacked paper products from outside of the interior area.

11. The cartridge of claim 10 wherein the first and second side walls are opposing side walls.

12. The cartridge of claim 10 wherein the plurality of side openings further include at least one side opening located in the third wall and configured so as to provide a visual indication of the number of paper products within the interior area.

13. The cartridge of claim 10 wherein the at least one additional opening comprises a plurality of slot openings defined within the first end wall and the fourth side wall so as to extend across the respective bottom corner.

14. The cartridge of claim 13 wherein said slot openings are substantially diamond shaped.

15. A cartridge for stacked paper products comprising:

a cartridge comprising a plurality of side walls and end walls, and wherein the end walls contact the side walls to define an interior area;

a dispensing opening defined within a first end wall;

at least one additional opening defined in the first end wall and one of the side walls; and stacked paper products disposed in the interior area oriented so as to extend substantially perpendicular to the side walls.

16. The cartridge of claim 15 wherein the dispensing opening is defined entirely within the first end wall.

17. The cartridge of claim 15 wherein the dispensing opening is defined within the first end wall and a side wall.

18. The cartridge of claim 17 further comprising a side opening located in the side wall and configured so as to provide a visual indication of the number of paper products within the interior area.

19. The cartridge of claim 15 wherein the at least one additional opening comprises a plurality of openings.

20. The cartridge of claim 19 wherein at least one of said additional openings is defined within the first end wall and first side wall and further wherein at least one of said additional openings is defined within the first end wall and a second side wall.

21. The cartridge of claim 20 wherein said first and second end walls oppose one another.

22. The cartridge of claim 20 further comprising a first side opening at least partially defined within a third side wall and a second side opening at least partially defined within a fourth side wall, the side openings configured to allow contact of the stacked paper products from outside of the interior area.

23. The cartridge of claim 20 further comprising a side opening located in the second side wall and configured so as to provide a visual indication of the number of paper products within the interior area.

24. A stacked paper product dispensing cartridge comprising:

a cartridge including a plurality of side walls and first and second end walls and wherein the end walls contact the side walls to define an interior area;

a dispensing opening at least partially defined within the first end wall;

at least one slot opening defined within the first end wall and one side wall; and stacked paper products disposed in the interior area oriented so as to extend substantially perpendicular to at least one of the side walls.

25. The cartridge of claim 24 wherein the at least one slot opening comprises a plurality of slot openings and wherein the plurality of slot openings are defined within the first end wall and a first side wall.

26. The cartridge of claim 25 wherein the dispensing opening is defined within the first end wall and a second side wall.

27. The cartridge of claim 26 wherein the first side wall and second side wall oppose one another.

28. The cartridge of claim 27 further comprising a side opening located in the second side wall and configured so as to provide a visual indication of the number of paper products within the interior area.

29. The cartridge of claim 27 further comprising a first side opening defined within at least a third side wall and a second side opening at least partially defined within a fourth side wall, the side openings configured to allow contact of the stacked paper products from outside of the interior area.

30. The cartridge of claim 24, wherein the at least one slot opening comprises a plurality of slot openings.

31. The cartridge of claim 30 wherein at least one of said slot openings is defined within the first end wall and first side wall and further wherein at least one of said slot openings is defined within the first end wall and a second side wall.

32. The cartridge of claim 31 wherein said first and second end walls oppose one another.

33. The cartridge of claim 32 wherein said dispensing opening is sized to provide metered delivery of paper products.

34. The cartridge of claim 33 wherein said dispensing opening is centrally located within the first end wall.

35. The cartridge of claim 33 wherein a plurality of slot openings are positioned on opposite sides of said dispensing opening.

36. The cartridge of claim 33 further comprising a first side opening at least partially defined within a third side wall and a second side opening at least partially defined within a fourth side wall, the side openings configured to allow contact of the stacked paper products from outside of the interior area.

37. The cartridge of claim 36 further comprising a side opening located in the second side wall and configured so as to provide a visual indication of the number of paper products within the interior area.

38. A stacked paper product dispensing cartridge comprising:

a plurality of walls including side walls and first and second end walls, the end walls contacting the side walls at opposite ends thereof and defining an interior area therein;

a first removable section for forming a dispensing opening, the first removable section including the entire first end wall and a portion of at least two of the side walls;

a plurality of side openings defined within the side walls and being spaced from the removable section; and stacked paper products disposed in the interior area oriented so as to extend substantially perpendicular to at least one of the side walls, the stacked paper products being dispensable out of the interior area through the dispensing opening and wherein said side openings are configured to allow contact of the stacked paper product from outside of the interior area.

39. The cartridge of claim 38 wherein said side walls comprise first, second, third and fourth side walls and wherein the plurality of side openings include a first side opening defined within the first side wall and a second side opening defined within the second side wall, the first and second side openings being configured to allow contact of the paper products from outside of the interior area.

40. The cartridge of claim 39 wherein the side walls are substantially longer than the end walls.

41. The cartridge of claim 39 wherein the first and second side walls are opposing side walls.

42. The cartridge of claim 41 including an additional opening located in the third wall and configured so as to provide a visual indication of the number of paper products within the interior area.

43. The cartridge of claim 41 wherein the removable section includes the entire first end wall and a portion of the first, second, third and fourth side walls.

* * * * *